US011587695B2

(12) United States Patent
Masuyama et al.

(10) Patent No.: US 11,587,695 B2
(45) Date of Patent: Feb. 21, 2023

(54) SILVER POWDER, PASTE COMPOSITION, AND METHOD OF PRODUCING SILVER POWDER

(71) Applicant: MITSUBISHI MATERIALS CORPORATION, Tokyo (JP)

(72) Inventors: Kotaro Masuyama, Naka (JP); Kazuhiko Yamasaki, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 93 days.

(21) Appl. No.: 16/819,319

(22) Filed: Mar. 16, 2020

(65) Prior Publication Data

US 2020/0219633 A1 Jul. 9, 2020

Related U.S. Application Data

(62) Division of application No. 15/549,476, filed as application No. PCT/JP2016/052008 on Jan. 25, 2016, now abandoned.

(30) Foreign Application Priority Data

Feb. 13, 2015 (JP) ..... JP2015-026265

(51) Int. Cl.
*B22F 9/24* (2006.01)
*H01B 1/02* (2006.01)
(Continued)

(52) U.S. Cl.
CPC ..... *H01B 1/02* (2013.01); *B22F 1/054* (2022.01); *B22F 1/0545* (2022.01); *B22F 9/24* (2013.01);
(Continued)

(58) Field of Classification Search
None
See application file for complete search history.

(56) References Cited

U.S. PATENT DOCUMENTS 3,377,160 A * 4/1968 Schroeder ..... H01M 4/90 502/347
9,745,645 B2 8/2017 Drmosh et al.
(Continued)

FOREIGN PATENT DOCUMENTS

CN 101529532 A 9/2009
CN 102211203 A 10/2011
(Continued)

OTHER PUBLICATIONS

English translation of CN 104277952 (originally published Jan. 14, 2015) obtained from Espacenet.*
(Continued)

*Primary Examiner* — George Wyszomierski
(74) *Attorney, Agent, or Firm* — Locke Lord LLP

(57) ABSTRACT

A silver powder is produced by reducing silver carboxylate and a particle size distribution of primary particles comprises a first peak of a particle size in a range of 20 nm to 70 nm and a second peak of a particle size in a range of 200 nm to 500 nm, organic matters are decomposed in an extent of 50 mass % or more at 150° C., gases generated in heating at 100° C. are: gaseous carbon dioxide; evaporated acetone; and evaporated water.

9 Claims, 1 Drawing Sheet

(51) Int. Cl.

| | |
|---|---|
| ***H01B 13/00*** | (2006.01) |
| ***H01B 1/22*** | (2006.01) |
| ***H01B 5/00*** | (2006.01) |
| ***B22F 1/054*** | (2022.01) |
| ***B22F 1/0545*** | (2022.01) |
| *B22F 1/16* | (2022.01) |

(52) U.S. Cl.
CPC ..... *H01B 1/22* (2013.01); *H01B 5/00* (2013.01); *H01B 13/00* (2013.01); *B22F 1/16* (2022.01)

(56) References Cited

U.S. PATENT DOCUMENTS

| | | | | |
|---|---|---|---|---|
| 10,214,657 | B2 | 2/2019 | Shukla et al. | |
| 2006/0073667 | A1 | 4/2006 | Li et al. | |
| 2006/0254387 | A1 | 11/2006 | Lee et al. | |
| 2008/0128656 | A1 | 6/2008 | Thollon et al. | |
| 2008/0173398 | A1 | 7/2008 | Yasuda et al. | |
| 2009/0149583 | A1 | 6/2009 | Lin et al. | |
| 2010/0090179 | A1 | 4/2010 | Mokhtari et al. | |
| 2010/0101637 | A1 | 4/2010 | Yamasaki et al. | |
| 2012/0043510 | A1 | 2/2012 | Kurihara et al. | |
| 2012/0048426 | A1 | 3/2012 | Ishizaki | |
| 2012/0091401 | A1 | 4/2012 | Hotta | |
| 2013/0114184 | A1 | 5/2013 | Kochi et al. | |
| 2013/0221287 | A1* | 8/2013 | Takahash | B22F 3/11 252/512 |
| 2015/0217374 | A1 | 8/2015 | Kim et al. | |
| 2015/0218391 | A1* | 8/2015 | Takahashi | C09D 5/24 252/514 |
| 2016/0114390 | A1* | 4/2016 | Hori | B22F 1/0014 252/512 |
| 2018/0193913 | A1 | 7/2018 | Iwai et al. | |
| 2021/0050319 | A1* | 2/2021 | Yamaguchi | H01B 1/02 |

FOREIGN PATENT DOCUMENTS

| | | | | |
|---|---|---|---|---|
| CN | 103003901 | A | | 3/2013 |
| CN | 104277952 | A | * | 1/2015 |
| JP | 2004-018891 | A | | 1/2004 |
| JP | 2004-068072 | A | | 3/2004 |
| JP | 2007-035353 | A | | 2/2007 |
| JP | 2008-060907 | A | | 3/2008 |
| JP | 2008-161907 | A | | 7/2008 |
| JP | 2009-191354 | A | | 8/2009 |
| JP | 2009-252507 | A | | 10/2009 |
| JP | 2010-095796 | A | | 4/2010 |
| JP | 2010-116625 | A | | 5/2010 |
| JP | 2010-150653 | A | | 7/2010 |
| JP | 2012-031478 | A | | 2/2012 |
| WO | 01/59520 | A1 | | 8/2001 |
| WO | 2008/105456 | A1 | | 9/2008 |
| WO | 2010/119630 | A1 | | 10/2010 |

OTHER PUBLICATIONS

International Search Report dated Apr. 5, 2016, issued for PCT/JP2016/052008 and English translation thereof.
Office Action dated Jul. 26, 2018, issued for the Chinese patent application No. 201680008343.X and English translation thereof.
Malkar Vishwabharati V et al: "Synthesis of silver nanoparticles in aqueous aminopolycarboxylic acid solutions via gamma-irradiation and hydrogen reduction", Materials Science and Engineering C, Elsevier Science S.A, CH, vol. 44, Aug. 9, 2014, pp. 87-91.
Search Report dated Oct. 1, 2018, issued for the European patent application No. 16749013.5.
Office Action dated Mar. 6, 2019, issued for U.S. Appl. No. 15/549,476.
Office Action dated Aug. 23, 2019, issued for U.S. Appl. No. 15/549,476.
Office Action dated Dec. 16, 2019, issued for U.S. Appl. No. 15/549,476.
Notice of Allowance dated May 27, 2021, issued for Korean Patent Application No. 10-2017-7021443 and English translation thereof.

* cited by examiner

SILVER POWDER, PASTE COMPOSITION, AND METHOD OF PRODUCING SILVER POWDER

This Application is a Division of U.S. application Ser. No. 15/549,476 filed on Aug. 8, 2017, now abandoned, which is a National Stage Entry of PCT Application No. PCT/JP2016/052008, filed on Jan. 25, 2016, which claims priority from Japanese Application 2015-026265, filed on Feb. 13, 2015 in Japan. The entire contents of these applications are incorporated herein by reference in their entirety.

TECHNICAL FIELD

The present invention relates to a silver powder used as a raw material of a conductive paste, a paste composition including the silver powder, and a method of producing the silver powder.

BACKGROUND ART

Conventionally, a synthetic method of metal nanoparticles for producing the metal nanoparticles is disclosed (for example, refer Patent Literature 1 (PTL 1)). In the method, the metal salt aqueous solution A is prepared by dissolving a metal salt; the carboxylate aqueous solution is prepared by dissolving a compound such as glycolic acid and citric acid; and the reducing agent aqueous solution is prepared. Then, the carboxylate solution B is mixed with one of the metal salt aqueous solution A and the reducing agent aqueous solution to form a mixed solution. Then, other of the metal salt aqueous solution A and the reducing agent aqueous solution is added to the mixed solution to be mixed further to produce the metal nanoparticles. In this synthetic method of metal nanoparticles, 75 mass % or more of silver is included in the metal salt as the metal element; and the mixing with the reducing agent aqueous solution is done by stirring at a temperature of 25° C. or more and 95° C. or less. In addition, the reducing agent is one or more compounds selected from a group consisting of hydrazine; ascorbic acid; oxalic acid; formic acid; and salts thereof.

Specifically, the above-mentioned PTL 1 describes the following. First, the carboxylic acid aqueous solution B is mixed with the aqueous metal salt solution. The degree of mixing at this time is preferably such that the total amount of carboxylic acid, carboxylate or carboxylic acid and carboxylate contained in the carboxylic acid aqueous solution B is 0.3 to 3.0 moles per 1 mole of the metal element contained in the metal salt aqueous solution A. In addition, it is preferable to perform the mixing at a temperature range of 25° C. to 95° C. under atmospheric pressure. Next, after the suspension in which the carboxylate is precipitated is obtained, an aqueous solution of the reducing agent is added to the suspension, which is the mixture, and further mixed. The degree of mixing at this time is preferably such that the reducing agent contained in the reducing agent aqueous solution A is from 0.1 to 3.0 moles per 1 mole of the metal element which is the raw material of the suspension. In addition, it is preferable to perform the mixing at a temperature range of 25° C. to 95° C. under atmospheric pressure.

In the synthetic method of metal nanoparticles configured as described above, all are made of CHNO except for the raw material metal as the raw material, since the metal nanoparticles are formed by forming the mixed solution by mixing the carboxylate aqueous solution B with one of the metal salt aqueous solution A and the reducing agent aqueous solution C; adding other of the metal salt aqueous solution A and the reducing agent aqueous solution C to the mixed solution; and further mixing the mixed solution. Therefore, it does not contain corrosive substances. Because of this, metal nanoparticles, which are suitable for used as a conductive material and do not contain corrosive substances, can be obtained even though the metal nanoparticles are produced from insoluble metal salts.

CITATION LIST

Patent Literature

PTL 1: Japanese Unexamined Patent Application, First Publication No. 2009-191354 (A) (claims 1 and 3, and the paragraph [0010])

SUMMARY OF INVENTION

Technical Problem

In the above-described synthetic method of metal nanoparticles disclosed in PTL 1, the carboxylic acid aqueous solution B is mixed with the metal salt aqueous solution A. That is, among the two silver precursor raw material aqueous solutions of the carboxylic acid aqueous solution B and the metal salt aqueous solution A, one of the silver precursor raw material aqueous solutions is dripped on the reaction tank filled with the other of the silver precursor raw material aqueous solutions is in advance as a reaction field. Therefore, in the conventional synthetic method of metal nanoparticles described in PTL 1, the growth of the metal nanoparticles proceeds at a relatively fast reaction rate and only the metal precursor, in which the particle size distribution of the primary particles has a single peak, is produced. Thus, even after adding the reducing agent to this metal precursor, only the metal nanoparticles, in which the particle size distribution of the primary particles has a single peak, can be obtained. As a result, there is a problem that a film cannot be deposited without firing at a relatively high temperature in forming a metal film by wet coating the metal nanoparticle dispersion, which is obtained by dispersing the above-described metal nanoparticles in a dispersion medium, on a substrate.

The first object of the present invention is to provide a silver powder and a method of producing the same, which are used for forming a silver film on a substrate at a relatively low firing temperature. The second object of the present invention is to provide a paste composition capable of forming a silver film on a substrate at a relatively low firing temperature. Furthermore, the third object of the present invention is to provide a silver powder and a paste composition which can form a silver film enabling to form a relatively thick silver film and reduce the volume resistivity of the silver film and a method for producing silver powder.

The relatively low firing temperature means 80° C. to 150° C., for example.

Solution to Problem

The first aspect of the present invention is a silver powder formed by reducing silver carboxylate, wherein a particle size distribution of primary particles includes a first peak of a particle size in a range of 20 nm to 70 nm and a second peak of a particle size in a range of 200 nm to 500 nm, organic matters are decomposed in an extent of 50 mass % or more at 150° C., gases generated in heating at 100° C. are: gaseous carbon dioxide; evaporated acetone; and evaporated water.

In the silver powder according to the first aspect of the present invention, the silver powder is formed by reducing silver carboxylate, and the particle size distribution of the primary particles has the first peak of the particle size in the range of 20 nm to 70 nm and the second peak of the particle size in the range of 200 nm to 500 nm. Since the primary particles with the small particle size fill the gap between the primary particles with the large particle size, the packing density of the silver powder is increased. Further, since the organic matter covering the present silver powder has a low molecular weight, the organic matters covering the silver powder are decomposed by 50 mass % or more at 150° C.; and the gases generated in heating at 100° C. are: gaseous carbon dioxide; evaporated acetone; and evaporated water. This technical effect is found as a result of conducting extensive studies about the combinations of the raw materials and processes used in the present invention and obtained by reducing the molecular weight of the organic molecules derived from the carboxylic acid adsorbed to the surface of the silver powder. As a result of decomposition of the coating, the surface of the silver powder becomes active, and the silver film containing the silver powder is sintered at a relatively low temperature. From the above, since the packing density of silver is high and the silver particles are connected to each other by sintering, the volume resistivity of the silver film can be lowered. By printing this paste composition containing the silver powder, it is possible to form a silver film, such as low resistance silver wiring, on the surface of a substrate such as a plastic film at a relatively low firing temperature.

The second aspect of the present invention is a paste composition comprising: the silver powder according to the first aspect; an amine; and a solvent.

In the paste composition of the second aspect of the present invention, since it contains the silver powder according to the first aspect, the amine and the solvent, as in the above-explained case, by printing this paste composition containing the silver powder, it is possible to form a silver film, such as low resistance silver wiring, on the surface of a substrate such as a plastic film at a relatively low firing temperature.

The third aspect of the present invention is the paste composition according to second aspect, wherein the amine is an amine with carbon number of 6 to 10, a mass average molecular weight of the amine is 101.19 to 157.30.

In the paste composition of the third aspect of the present invention, the amine has the carbon number of 6 to 10 and the mass average molecular weight of 101.19 to 157.30. Thus, the amine easily volatilizes at a low temperature for the low temperature sinterability not to be inhibited. In addition, the amine adsorbs on the surface of the silver powder for the dispersibility to be improved. Accordingly, the silver film having high silver packing density can be obtained.

The fourth aspect of the present invention is a method of producing a silver powder including the steps of:

preparing a silver carboxylate slurry by dripping a silver salt aqueous solution and a carboxylate aqueous solution of in water simultaneously;

preparing a silver powder slurry by performing a predetermined heat treatment after dripping a reducing agent aqueous solution to the silver carboxylate slurry; and obtaining a silver powder by drying the silver powder slurry.

In the method of producing a silver powder according to the fourth aspect of the present invention, first, the silver carboxylate slurry is prepared by dripping the silver salt aqueous solution and the carboxylate aqueous solution of in water simultaneously. Then, the silver powder slurry is prepared by performing a predetermined heat treatment after dripping a reducing agent aqueous solution to the silver carboxylate slurry. Then, the silver powder is obtained by drying the silver powder slurry. Therefore, the process of forming minute nuclei of the silver precursor and the process of growing minute nuclei of the silver precursor proceed at a relatively slow reaction rate in a system, in which the raw material concentrations are dilute, for the growth of nuclei of some precursors to be promoted. Thus, the mixed population of the silver precursor having a large primary particle size and the silver precursor having a small primary particle size is formed. It is believed this is why the silver powder having two peaks in the particle size distribution of primary particles can be obtained. As a result, primary particles having a small particle size are filled in the gaps of the primary particles having a large particle size, and the packing density of the silver powder is increased. Thus, the silver film can be formed at a relatively low firing temperature. In addition, a relatively thick silver film can be formed; and the volume resistivity of the silver film can be reduced.

The fifth aspect of the present invention is the method of producing a silver powder according to the fourth aspect, wherein a silver salt in the silver salt aqueous solution is one or more compounds selected from a group consisting of: silver nitrate; silver chlorate; and silver phosphate.

The sixth aspect of the present invention is the method of producing a silver powder according to the fourth aspect, wherein a carboxylic acid in the carboxylate aqueous solution is one or more compound selected from a group consisting of: glycolic acid; citric acid; malic acid; maleic acid; malonic acid; fumaric acid; succinic acid; tartaric acid; and salts thereof.

The seventh aspect of the present invention is the method of producing a silver powder according to the fourth aspect, wherein a reducing agent in the reducing agent aqueous solution is one or more compound selected from a group consisting of: hydrazine; ascorbic acid; oxalic acid; formic acid; and salts thereof.

The eighth aspect of the present invention is a method of producing a silver film comprising the steps of:

preparing a silver paste by dispersing the silver powder according to the first aspect or the silver powder produced by the method according to the fourth aspect in a solvent;

applying the silver paste on a substrate; and forming a silver film on the substrate by drying and calcining the substrate on which the silver paste is applied.

The ninth aspect of the present invention is the method of producing a silver film including the steps of:

applying the paste composition according to the second or third aspect on a substrate;

forming a silver film on the substrate by drying and calcining the substrate on which paste composition is applied.

Advantageous Effects of Invention

According to the silver powder, the paste composition, and the method of producing silver powder, which are the aspects of the present invention, it is possible to form a silver film on the substrate at a relatively low firing temperature. In addition, the relatively thick silver film can be formed, and the volume resistivity of the silver film can be reduced.

DESCRIPTION OF EMBODIMENTS

Figure 1:
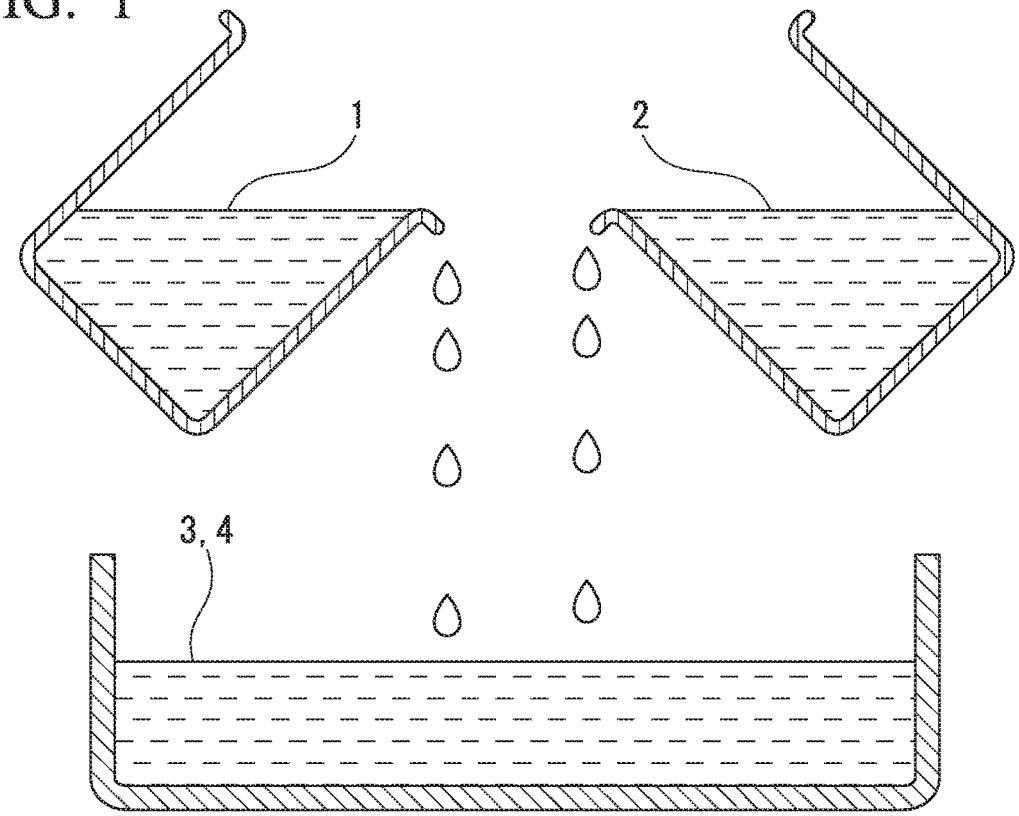
FIG. 1 is a conceptual diagram showing the state in which the silver carboxylate slurry (silver citrate slurry) is prepared by dripping the silver salt aqueous solution (silver nitrate aqueous solution) and the carboxylate aqueous solution (ammonium citrate aqueous solution) of in water (ion-exchanged water) simultaneously in an embodiment of the present invention (Example of the present invention).

Next, embodiments of the present invention are explained in reference to drawings. The silver powder, which is an aspect of the present invention, (hereinafter referred to as "the silver powder of the present invention") is produced by reducing silver carboxylate, and the particle size distribution of primary particles includes the first peak of a particle size in the range of 20 nm to 70 nm, preferably in the range of 30 nm to 50 nm, and the second peak of a particle size in the range of 200 nm to 500 nm, preferably in the range of 300 nm to 400 nm.

In addition, the organic matters covering the silver powder are decomposed at 150° C. in the extent of 50 mass % or more, preferably 75 mass % or more, of the silver powder. In this case, the time for silver powder to be exposed to 150° C. is 30 minutes in the atmosphere. Further, the gases generated in heating the silver powder in the powder state at 100° C. are: gaseous carbon dioxide; evaporated acetone; and evaporated water.

Here, the reason why the particle size of the first peak in the particle size distribution of the primary particles of the silver powder is limited within the range of 20 nm to 70 nm is that when it is less than 20 nm, there is a tendency that thickening the silver film becomes difficult, and when it exceeds 70 nm, there is a tendency that the volume resistivity of the silver film is increased. In addition, the reason why the particle size of the second peak in the particle size distribution of the primary particles of the silver powder is limited within the range of 200 nm to 500 nm is that when the thickness is less than 200 nm, there is a tendency that thickening of the silver film tends to be difficult, and when it exceeds 500 nm, there is a tendency that the volume resistivity of the silver film is increased. The reason why the decomposition rate of the organic matters covering the silver powder at 150° C. is limited to 50 mass % or more is that when the content is less than 50 mass %, the silver powder is difficult to be sintered and the volume resistivity of the silver film is increased. Furthermore, the reason why the gases generated when the silver powder in the powder state is heated at 100° C. is limited to the gaseous carbon dioxide, the evaporated acetone and the evaporated water, is that the gases are derived from the organic molecules adsorbed on the surface of the silver powder. The lower the molecular weight of these organic matters, the easier it is to be separated or released from the surface of the silver powder by heating, and as a result, the silver powder is easy to be sintered.

With respect to the particle sizes of the first and second peaks, the silver powder is observed with a scanning electron microscope (SEM), particle sizes of 1000 or more silver particles were measured, and the two top peaks having the largest number of particle sizes are defined as the first and the second peaks, the smaller one being the first peak and the larger one being the second peak.

More specifically, the particle size distribution of primary particles of the silver powder can be obtained by observing silver powder with a scanning electron microscope (SEM). In this observation, the particle size of 1,000 silver particles is measured, and a particle size distribution graph is created with the horizontal axis representing the particle size and the vertical axis representing the frequency distribution. Then, with respect to each individual peak, the top two peaks having the largest number of particles belonging to that peak are identified. For the two identified peaks, the median value of the particle size of the particle belonging thereto is defined as the particle size of the peak. Among the two peaks, the one having the smaller particle size is defined as the first peak, and the one having the larger particle size is defined as the second peak.

In addition, the gases generated when heating the silver powder are identified by analyzing the gases generated using pyrolysis GC/MS (gas chromatograph mass spectrometer with a pyrolysis apparatus installed in the part where the silver powder is introduced).

A paste composition, which is another aspect of the present invention, (hereinafter referred to as "paste composition of the present invention") contains the silver powder, an amine, and a solvent. The amine preferably has the carbon number of 6 to 10 and the mass average molecular weight of 101.19 to 157.30. Specific examples of the amine include: hexylamine; octylamine; decylamine; and the like. Specific examples of the solvent include: ethanol; ethylene glycol; butyl carbitol acetate; and the like. The reason why the number of carbon atoms of the amine is limited in the range of 6 to 10 and the weight average molecular weight of the amine is limited within the range of 101.19 to 157.30 is because when the number of carbon atoms of the amine is less than 6 and the weight average molecular weight of the amine is less than 101.19, the dispersibility of the silver powder is not sufficiently improved for the packing density of silver in the silver film after sintering tends not to be improved; and when the amine has carbon atoms exceeding 10 and the weight average molecular weight exceeds 157.30, the amine volatilizes slowly at the time of firing. Thus, the amine volatilizes at a relatively high temperature, and it tends to hinder the sintering of the silver powder.

The method of producing the silver powder using the paste composition configured as described above will be explained below. First, as shown in FIG. 1, the silver salt aqueous solution 1 and the carboxylate salt aqueous solution 2 are simultaneously dripped into the water 3 to prepare the silver carboxylate slurry 4. At this time, it is preferable to maintain the temperature of each of the liquids 1 to 4 at a predetermined temperature within the range of 20° C. to 90° C. The reason why the temperature of each of the solutions 1 to 4 is kept at the predetermined temperature within the range of 20° C. to 90° C. is that when the temperature is lower than 20° C., the silver carboxylate is difficult to form, the volume resistivity of the silver film is increased. When the temperature exceeds 90° C., the silver powder becomes coarse particles and the silver powder with intended particle sizes cannot be obtained. It is preferable that the water 3 is stirred while the silver salt aqueous solution 1 and the carboxylate salt aqueous solution 2 are simultaneously dripped into the water 3. In addition, it is preferable that the silver salt in the silver salt aqueous solution 1 is one or more compounds selected from the group consisting of silver nitrate, silver chlorate, and silver phosphate. It is preferable that the carboxylic acid in the carboxylate aqueous solution 2 is one or more compounds selected from the group consisting of glycolic acid, citric acid, malic acid, maleic acid, malonic acid, fumaric acid, succinic acid, tartaric acid and salts thereof. Further, as the water 3, ion-exchanged water, distilled water and the like can be mentioned. Use of the ion-exchanged water is particularly preferable since it does not contain ions that may adversely affect the synthesis and production cost is low as compared with distilled water.

Figure 2:
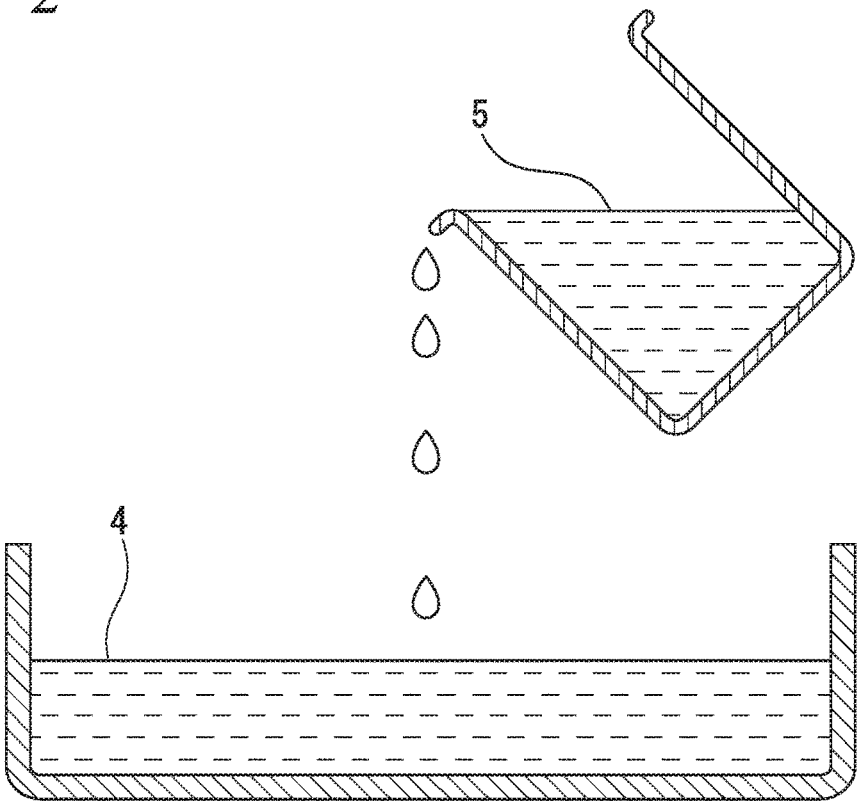
FIG. 2 is a conceptual diagram showing the state where the reducing agent aqueous solution (ammonium formate aqueous solution) is dripped on the silver carboxylate slurry (silver citrate slurry) in an embodiment of the present invention (Example of the present invention).

Next, as shown in FIG. 2, the silver powder slurry is prepared by performing a predetermined heat treatment after dripping the reducing agent aqueous solution 5 to the silver carboxylate slurry 4. At this time, it is preferable to keep the temperature of each of solutions 4, 5 at a predetermined temperature within the range of 20° C. to 90° C. The reason why the temperature of each of solutions 4 and 5 is kept at a predetermined temperature within the range of 20° C. to 90° C. is that when the temperature is lower than 20° C., it is difficult to reduce the silver carboxylate and the volume resistivity of the silver film is increased. When the temperature exceeds 90° C., the silver powder becomes coarse particles and the silver powder with intended particle sizes cannot be obtained. The reducing agent in the reducing agent aqueous solution 5 is preferably one or more compounds selected from the group consisting of hydrazine, ascorbic acid, oxalic acid, formic acid, and salts thereof. Further, the predetermined heat treatment is carried out by raising the temperature to a predetermined temperature (maximum temperature) within the range of 20° C. to 90° C. at a rate of temperature rise of 15° C./hour or less in water, holding the maximum temperature for 1 to 5 hours. Then, the temperature is reduced to 30° C. or less over a period of 30 minutes or less. The reason for limiting the heating rate to 15° C./hour or less is that when the rate exceeds 15° C./hour, the silver powder becomes coarse particles, and silver powder having intended particle sized cannot be obtained. The reason why the maximum temperature is limited within the range of 20° C. to 90° C. is that when the temperature is lower than 20° C., it is difficult to reduce silver carboxylate, and the volume resistivity of the silver film is increased. When it exceeds 90° C., the silver powder becomes coarse and the silver powder having intended particle sizes cannot be obtained. The reason why the retention time at the maximum temperature is limited within the range of 1 to 5 hours is that when the time is less than 1 hour, the reduction of silver carboxylate does not sufficiently occur, and the volume resistivity of the silver film is increased. When it exceeds 5 hours, the silver powder becomes coarse particles, and silver powder having the intended particle sizes cannot be obtained. Furthermore, the time to lower the temperature to 30° C. is limited to 30 minutes or less is that when the time exceeds 30 minutes, the silver powder tends to become coarse and the silver powder having the intended particle sizes cannot be obtained.

Further, the silver powder slurry is dried to obtain silver powder. Here, before drying the silver powder slurry, it is preferable to remove the liquid phase in the silver powder slurry by a centrifuge and to dehydrate and desalinate the silver powder slurry. Examples of the drying method of the silver powder slurry include a freeze drying method, a reduced pressure drying method, a heat drying method, and the like. The freeze-drying method is a method of freezing the silver powder slurry in a sealed container, reducing the boiling point of the material to be dried by reducing the pressure inside the closed container with a vacuum pump, sublimating the water content of the material to be dried at a low temperature for the material to be dried. Further, the reduced pressure drying method is a method of drying an object to be dried by reducing the pressure. Further, the heat drying method is a method of heating and drying the material to be dried.

The reason why the particle distribution of the primary particles of the silver powder includes two peaks when the silver powder is produced by the above-described method is explained (conjectured) below. First, the silver carboxylate slurry is prepared by simultaneously dripping the silver salt aqueous solution and the carboxylate aqueous solution into the water, so that the process of forming minute nuclei of the silver precursor and the process of growing minute nuclei of the silver precursor are considered to proceed at a relatively slow reaction rate in the system in which the raw material concentrations are dilute. As a result, the growth of nuclei of a part of the precursor is promoted, so that a mixture of a silver precursor having a relatively large primary particle size and a silver precursor having a relatively small primary particle size is generated. Next, after the reducing agent aqueous solution is dripped into the silver carboxylate slurry, the predetermined heat treatment is performed to prepare the silver powder slurry, and the silver powder slurry is dried to obtain silver powder. Accordingly, it is conjectured that the silver powder, in which the particle size distribution of the primary particles has two peaks, is obtained.

The method of producing the silver film using the silver powder or the silver powder produced by the above-described method will be described below. First, the silver powder is dispersed in the solvent to prepare the silver paste. Examples of the solvent include ethanol, ethylene glycol, butyl carbitol acetate and the like. Next, this silver paste is applied to the substrate. Examples of the substrate include polyethylene terephthalate (PET) film, polyimide film, polyethylene naphthalate (PEN) film, glass and the like. Further, the substrate coated with silver paste is dried and fired to form the silver film on the substrate. The drying temperature and drying time of the substrate coated with the silver paste are preferably 50° C. to 80° C. and 30 to 60 minutes, respectively. Further, the firing temperature and the firing time of the substrate coated with the silver paste are preferably 80° C. to 150° C. and 10 to 60 minutes, respectively, and the firing atmosphere is preferably an air atmosphere, a nitrogen atmosphere or the like.

Here, the reason why the drying temperature of the substrate coated with the silver paste is limited within the range of 50° C. to 80° C. is that when the temperature is lower than 50° C., drying of the solvent becomes slow and firing unevenness is likely to occur. When it exceeds 80° C., cracks tend to occur in the coating film of the silver paste. The reason why the drying time of the substrate coated with the silver paste is limited to 30 to 60 minutes is that when it is less than 30 minutes, drying of the solvent becomes insufficient, and firing unevenness is likely to occur. When it exceeds 60 minutes, the coating film of the silver paste tends to be cracked. The reason why the firing temperature of the substrate coated with the silver paste is limited to 80° C. to 150° C. is that when the temperature is less than 80° C., sintering of the silver paste coating film becomes difficult to proceed and the volume resistivity of the silver powder is increased. When it exceeds 150° C., warpage or cracking tends to occur in the coating film of the silver paste. The reason why the firing time of the substrate coated with the silver paste is limited within the range of 10 to 60 minutes is that when it is less than 10 minutes, sintering of the silver paste coating film is difficult to proceed and the volume resistivity of the silver film is increased. When it exceeds 60 minutes, warping and cracking are likely to occur in the coating film of the silver paste.

The silver film can be produced using the paste composition. In this case, the above-described paste composition is first applied to the substrate. As the substrate, a polyethylene terephthalate (PET) film, a polyimide film, a polyethylene naphthalate (PEN) film, a glass and the like are mentioned as in the method of producing the silver film using the silver powder or the silver powder produced by the above-described method. Next, the substrate coated with the paste composition is dried and fired to form the silver film on the substrate. The drying temperature and the drying time of the substrate coated with the paste composition are adjusted to 50° C. to 80° C. and 10° C. to 60° C., respectively, in the same manner as the method of producing the silver film using the silver powder or the silver powder manufactured by the above-described method. The firing temperature and the firing time of the substrate coated with the paste composition are the same as those of the silver powder or the silver powder produced by the above-described method and preferably set to 80° C. to 150° C. and 10° C. to 60° C., respectively. The reasons for limiting the temperature and time range are the same as the method for producing the silver film using the silver powder or the silver powder manufactured by the above-described method, so that repeated explanation is omitted.

In the silver film produced as described above, the silver powder is produced by reducing silver carboxylate, and the particle size distribution of the primary particles has the first peak within the range of the particle size of 20 nm to 70 nm and the second peak in the range of the particle size of 200 nm to 500 nm. Thus, the primary particles having the small particle size are filled in the gaps between the primary particles having a large particle size and the packing density of the silver powder is increased. Further, since the organic matters covering the present silver powder has a low molecular weight, the organic matter covering the silver powder is decomposed by 50 mass % or more at 150° C., and when the silver powder is heated at 100° C., the gases generated is gaseous carbon dioxide, evaporated acetone and evaporated water. This technical effect is found as a result of conducting extensive studies about the combinations of the raw materials and processes used in the present invention and obtained by reducing the molecular weight of the organic molecules derived from the carboxylic acid adsorbed to the surface of the silver powder. As a result of decomposition of the coating, the surface of the silver powder becomes active, and the silver film containing the silver powder is sintered at a relatively low temperature. From the above, since the packing density of silver is high and the silver particles are connected to each other by sintering, the volume resistivity of the silver film can be lowered. By printing this paste composition containing the silver powder, it is possible to form a silver film, such as low resistance (low volume resistivity) silver wiring, on the surface of a substrate having a relatively low melting point such as a polyethylene terephthalate (PET) film, a polyimide film, a polyethylene naphthalate (PEN) at a relatively low firing temperature.

EXAMPLES

Next, Examples of the present invention will be described in detail together with Comparative Examples.

Example 1

First, as shown in FIG. 1, the silver citrate slurry 4 (silver carboxylate aqueous solution) was prepared by dripping 900 g of the silver nitrate aqueous solution 1 (silver salt aqueous solution) held at 50° C. and 600 g of the ammonium citrate aqueous solution 2 (carboxylate aqueous solution) held at 50° C. simultaneously to 1200 g of the ion-exchanged water 3 (water) held at 50° C., over 5 minutes. While the silver nitrate aqueous solution 1 and the ammonium citrate aqueous solution 2 were simultaneously dropped into the ion-exchanged water 3, the ion-exchanged water 3 was continuously stirred. Further, the concentration of the silver nitrate in the silver nitrate aqueous solution 1 was 66 mass %; and the concentration of citric acid in the ammonium citrate aqueous solution 2 was 56 mass %. Next, as shown in FIG. 2, 300 g of ammonium formate aqueous solution 5 (reducing agent aqueous solution) held at 50° C. was dripped on the above-mentioned silver citrate slurry 4 held at 50° C., over 30 minutes to obtain the mixed slurry. The concentration of formic acid in the ammonium formate aqueous solution 5 was 58% by mass. Next, the predetermined heat treatment was performed on the mixed slurry. Specifically, the mixed slurry was heated to a maximum temperature of 70° C. at a rate of temperature increase of 10° C./hours, and then, kept at 70° C. (maximum temperature) for 2 hours. Then, the temperature was lowered to 30° C. over 60 minutes. Thereby, the silver powder slurry was obtained.

The silver powder slurry was placed in a centrifuge and spanned at a rotation speed of 1000 rpm for 10 minutes. As a result, the liquid phase in the silver powder slurry was removed, and the dehydrated-and-desalted silver powder slurry was obtained. The dehydrated and desalted silver powder slurry was dried for 30 hours by the freeze drying method to obtain silver powder. Then, the silver powder, octylamine (amine) and ethylene glycol (solvent) were placed in a container such that the mass ratio was 80:15:5, and the mixture was kneaded with a kneader (Awatori Rentarou manufactured by THINKY Co.) at 2000 rpm. The mixture was kneaded three times to rotate at a speed of 5 minutes. Thereby, the silver paste which was a paste composition containing the silver powder was obtained. Further, the silver paste was printed on a glass substrate using a metal mask (plate size: 12 mm in length×15 mm in width×50 μm in thickness), molded, and fired at 120° C. for 30 minutes in the air atmosphere. As a result, the silver film was formed on the glass substrate. The silver film formed on this glass substrate was referred to as Example 1 of the present invention.

Examples 2 to 9 and Comparative Examples 1 to 8

The silver films formed on the glass substrates were formed as Examples 2 to 9 of the present invention and Comparative Examples 1 to 8, by varying: the time for the simultaneous dripping of the solutions 1 and 2; the heating rate of the silver powder obtained by dripping the ammonium formate aqueous solution on the silver citrate slurry; the maximum temperature and the retention time at the maximum temperature; the maintaining temperatures of each of solutions 1 to 5; and kinds of the reducing agent aqueous solution 5 (condition), as shown in Table 1. The silver film was formed on the glass substrate by preparing the silver paste using the silver powder, applying the silver paste on the glass substrate, and then, dry and firing in the same manner as in Example 1, except for the conditions shown in Table 1.

Comparative Test 1 and Evaluation

In Examples 1 to 9 of the present invention and Comparative Examples 1 to 8, the particle size distribution of the primary particles of the silver powder; the decomposition rate (decomposition rate of organic matters) of the organic matters covering the silver powder at a predetermined temperature; and kinds of the gases generated from the organic matters coating the silver powder when the silver powder in the powder state was heated, were measured. Regarding the particle size distribution of the primary particles of the silver powder, the silver powder was observed with a scanning electron microscope (SEM); the particle size of 1,000 silver particles were measured, the top two values with higher numbers in the particle sizes were calculated. Then, the smaller one was defined as the particle size of the first peak, and the larger one was defined as the particle size of the second peak. The decomposition rate of the organic matters was obtained by measuring the amount of decrease in mass after heating relative to before heating, after holding the silver powder in the air at 150° C. for 30 minutes. Furthermore, the kind of the above-mentioned heating-generating gases was identified by analyzing the gas generated using the pyrolysis GC/MS (gas chromatograph mass spectrometer having a pyrolysis apparatus installed at the part where silver powder is introduced). The results are shown in Table 1. In addition, the time for the simultaneous dripping of the solutions 1 and 2; the heating rate of the silver powder obtained by dripping the ammonium formate aqueous solution on the silver citrate slurry; the maximum temperature and the retention time at the maximum temperature; the maintaining temperatures of each of solutions 1 to 5; and kinds of the reducing agent aqueous solution 5 are shown in Table 1. Among the heating-generated gases of Table 1, $CO_2$ was gaseous carbon dioxide; and acetone, water, ethanediol, acetic acid, pyrrole, aniline and decane were evaporated substances thereof.

TABLE 1

| | Silver powder | | | | | | | | | |
|---|---|---|---|---|---|---|---|---|---|---|
| | Simultaneous dripping time of solutions 1 and 2 (minutes) | Holding temperature of solutions 1 to 5 (° C.) | Kind of the reducing agent aqueous solution 5 | Silver powder slurry | | | Particle distribution of the primary particles | | Decomposition rate of organic matters (mass %) | Kind of gases generated in heating |
| | | | | Heating rate (° C./H) | Maximum temperature (° C.) | Retention time (H) | Frist peak (nm) | Second peak (mu) | | |
| Example 1 | 5 | 50 | Ammonium formate aqueous solution (58 mass %) | 10 | 70 | 2 | 40 | 400 | 80 | $CO_2$, acetone, water |
| Example 2 | 5 | 20 | Same as above | 10 | 70 | 2 | 30 | 400 | 80 | $CO_2$, acetone, water |
| Example 3 | 5 | 80 | Same as above | 10 | 80 | 2 | 70 | 500 | 70 | $CO_2$, acetone, water |
| Example 4 | 30 | 30 | Same as above | 10 | 70 | 2 | 40 | 400 | 80 | $CO_2$, acetone, water |
| Example 5 | 450 | 30 | Same as above | 10 | 70 | 2 | 30 | 350 | 70 | $CO_2$, acetone, water |
| Example 6 | 5 | 50 | Same as above | 15 | 70 | 2 | 50 | 400 | 80 | $CO_2$, acetone, water |
| Example 7 | 5 | 30 | Same as above | 0 | 30 | 5 | 20 | 200 | 50 | $CO_2$, acetone, water |
| Example 8 | 5 | 50 | Same as above | 10 | 70 | 1 | 30 | 250 | 60 | $CO_2$, acetone, water |
| Example 9 | 5 | 50 | Same as above | 10 | 70 | 5 | 60 | 450 | 80 | $CO_2$, acetone, water |
| Comparative Example 1 | 5 | 10 | Same as above | 10 | 70 | 2 | 30 | 100 | 45 | $CO_2$, acetone, water, ethanediol |

TABLE 1-continued

| | Silver powder | | | | | | | | | |
|---|---|---|---|---|---|---|---|---|---|---|
| | Simultaneous dripping time of solutions 1 and 2 (minutes) | Holding temperature of solutions 1 to 5 (° C.) | Kind of the reducing agent aqueous solution 5 | Silver powder slurry | | | Particle distribution of the primary particles | | Decomposition rate of organic matters (mass %) | Kind of gases generated in heating |
| | | | | Heating rate (° C./H) | Maximum temperature (° C.) | Retention time (H) | Frist peak (nm) | Second peak (mu) | | |
| Comparative Example 2 | 5 | 90 | Same as above | 10 | 90 | 2 | Coarse particles were formed | | 70 | $CO_2$, acetone, water, ethanediol |
| Comparative Example 3 | 5 | 50 | Same as above | 20 | 70 | 2 | 80 | 500 | 80 | $CO_2$, acetone, water, ethanediol |
| Comparative Example 4 | 5 | 20 | Same as above | 0 | 20 | 5 | 20 | 150 | 30 | $CO_2$, acetone, water, ethanediol |
| Comparative Example 5 | 5 | 50 | Same as above | 10 | 70 | 0.5 | 30 | 300 | 30 | $CO_2$, acetone, water, ethanediol |
| Comparative Example 6 | 5 | 50 | Same as above | 10 | 70 | 8 | 80 | 550 | 80 | $CO_2$, acetone, water |
| Comparative Example 7 | SPQ03S (silver powder manufactured by Mitsui Mining & Smelting Co.) | | | | | | — | 750 | 5 | $CO_2$, acetic acid, pyrrole |
| Comparative Example 8 | HP02A (silver powder manufactured by Mitsui Mining & Smelting Co.) | | | | | | — | 250 | 20 | $CO_2$, aniline, decane |

As is apparent from Table 1, in Comparative Example 1, in which the holding temperature of the solutions 1 to 5 was 10° C., since the growth rate of the silver powder was slow, the second peak of the particle size distribution of the primary particles of the silver powder was reduced to 100 nm. In Comparative Example 2, in which the decomposition rate of the organic substance at 150° C. was as low as 45 mass % and the holding temperature of the solutions 1 to 5 was 90° C., coarse particles were formed, and silver powder of the intended particle sizes could not be obtained. In Comparative Example 3, in which the rate of temperature rise of the silver powder slurry was 20° C./hour, the first peak was increased to 80 nm. In Comparative Example 4, in which the maximum temperature of the silver powder slurry was 20° C., since the reduction rate of the silver carboxylate and the growth rate of silver powder was slow, the second peak of the silver powder was reduced to 150 nm. In addition, in Comparative Example 5, in which the retention time of the silver powder slurry was 0.5 hour, since the retention time was short, organic molecules with high degradability were not adsorbed on the surface of the silver powder; and the decomposition rate of organic matters at 150° C. was reduced to 30 mass %. In Comparative Example 6, in which the retention time of the silver powder slurry was 8 hours, the first and second peaks of the silver powder became large at 80 nm and 550 nm, respectively. Moreover, in Comparative Examples 7 and 8 using the commercially available silver powders (silver powder manufactured by Mitsui Mining Industry Co., Ltd.), when heated at 100° C., heat-generated gases other than gaseous carbon dioxide, the evaporated acetone, and the evaporated water (such as evaporated acetic acid, pyrrole, aniline, and decane) were detected. In contrast to these, in Examples 1 to 9 of the present invention, in which the time for the simultaneous dripping of the solutions 1 and 2; the heating rate of the silver powder obtained by dripping the ammonium formate aqueous solution on the silver citrate slurry; the maximum temperature and the retention time at the maximum temperature; the maintaining temperatures of each of solutions 1 to 5; and kinds of the reducing agent aqueous solution 5 (condition), were set within the ranges as shown in Table 1, the silver powders, in which the particle size distribution of the primary particles included the first peak of the particle size in the range of 20 to 70 nm and the second peak of the particle size in the range of 200 to 500 nm; the organic matters decomposed at the extent of 50 mass % to 80 mass % (50 mass % or more) at 150° C.; and when heated at 100° C., only gaseous carbon dioxide, the evaporated acetone and the evaporated water were generated without generation of other heat-generated gases. In Comparative Examples 1 to 5, evaporated ethanediol was detected in addition to the gaseous carbon dioxide, the evaporated acetone and the evaporated water when heated at 100° C. The reason for this is conjectured that since the silver powder was synthesized under the condition, in which any one of numeric ranges of: the first or the second peak in the particle distribution of the primary particles; the decomposition rate of the organic matters at 150° C.; and the like was deviated from the numeric ranges described in the first aspect of the present invention, organic matters, which had a molecular weight larger than Examples 1 to 9 of the present invention, were adsorbed on the surface of the silver powder to be decomposed to the gases made of molecules with a molecular weight larger than carbon dioxide, acetone and water in heating at 100° C.

Comparative Test 2 and Evaluation

Film thickness and volume resistivity of the silver films formed on the glass substrates of Examples 1 to 9 of the present invention and Comparative Examples 1 to 8 were measured. The film thickness (cm) of the silver film was obtained by observing the outer edge part of the silver film formed on the glass substrate with a laser microscope (VK-X 200 manufactured by KEYENCE Corporation, magnification: 200 times). The volume resistivity of the silver film was measured by measuring the surface resistivity (Ω/□(square)) of the silver film formed on the glass substrate with a resistance meter (LORESTA-AP MCP-T 400 manufactured by Mitsubishi Yushi Co.). The volume resistivity (Ω·cm) was obtained by multiplying the measured value (Ω/□) by the film thickness (cm). The results are shown in Table 2. In addition, the first and second peaks of the silver powder, the decomposition rate of the organic matters, and the kind of the heat-generated gases are shown in Table 2. Among the kinds of the heat-generated gases in Table 2, $CO_2$ is gaseous carbon dioxide; and acetone, water, ethanediol, acetic acid, pyrrole, aniline and decane are evaporated substances thereof.

TABLE 2

| | Silver powder | | | | Silver film | |
|---|---|---|---|---|---|---|
| | Particle distribution of primary particles | | Decomposition rate of organic matters (mass %) | Kind of gases generated in heating | Film thickness (μm) | Volume resistivity (μΩ · m) |
| | First peak (nm) | Second peak (nm) | | | | |
| Example 1 | 40 | 400 | 80 | $CO_2$, acetone, water | 45 | 7 |
| Example 2 | 30 | 400 | 80 | $CO_2$, acetone, water | 50 | 7 |
| Example 3 | 70 | 500 | 70 | $CO_2$, acetone, water | 50 | 10 |
| Example 4 | 40 | 400 | 80 | $CO_2$, acetone, water | 45 | 7 |
| Example 5 | 30 | 350 | 70 | $CO_2$, acetone, water | 45 | 7 |
| Example 6 | 50 | 400 | 80 | $CO_2$, acetone, water | 50 | 7 |
| Example 7 | 20 | 200 | 50 | $CO_2$, acetone, water | 45 | 11 |
| Example 8 | 30 | 250 | 60 | $CO_2$, acetone, water | 50 | 11 |
| Example 9 | 60 | 450 | 80 | $CO_2$, acetone, water | 50 | 8 |
| Comparative Example 1 | 30 | 100 | 45 | $CO_2$, acetone, water, ethanediol | 30 | 20 |
| Comparative Example 2 | Coarse particles were formed | | 70 | $CO_2$, acetone, water, ethanediol | — | — |
| Comparative Example 3 | 80 | 500 | 80 | $CO_2$,acetone, water, ethanediol | 50 | 15 |
| Comparative Example 4 | 20 | 150 | 30 | $CO_2$, acetone, water, ethanediol | 30 | 20 |
| Comparative Example 5 | 30 | 300 | 30 | $CO_2$, acetone, water-ethanediol | 45 | 22 |
| Comparative Example 6 | 80 | 550 | 80 | $CO_2$, acetone, water | 50 | 14 |
| Comparative Example 7 | — | 750 | 5 | $CO_2$, acetic acid, pyrrole | 50 | 400 |
| Comparative Example 8 | — | 250 | 20 | $CO_2$, aniline, decane | 50 | 100 |

As is apparent from Table 2, in Comparative Example 1, since the second peak of the silver powder was as small as 30 nm and the decomposition rate of the organic matters at 150° C. was as low as 45 mass %, the film thickness of the silver film was 30 μm; and the volume resistivity of the silver film became as high as 20 Ω·cm. In Comparative Example 2, since coarse particles were formed, the paste having the viscosity suitable for printing could not be prepared. In Comparative Example 3, since the first peak of the silver powder was as large as 80 nm, the filling degree of the silver film was reduced and the volume resistivity of the silver film was increased to 15 μΩ·cm. In Comparative Example 4, since the decomposition rate of the organic matters was as low as 30 mass % at 150° C. and silver powder having a surface with a good sintering property could not be obtained, the volume resistivity became as high as 20 μΩ·cm. In Comparative Example 5, since the grain growth of the silver powder did not proceed sufficiently and the film thickness of the silver film became as thin as 45 μm, the volume resistivity of the silver film became high as 22 μΩ·cm. In Comparative Example 6, since the first and second peaks of the silver powder increased to 80 nm and 550 nm, respectively, the filling degree of the silver film was lowered and the volume resistivity of the silver film was increased to 14 μΩ·cm. Moreover, in Comparative Examples 7 and 8, the gases other than the heat-generated gases of the gaseous carbon dioxide, the evaporated acetone and the evaporated water (such as evaporated acetic acid, pyrrole, aniline, and decane) were identified when heated at 100° C. Accordingly, the organic matters on the surface of the silver powder became difficult to be decomposed at 100° C., and sintering of the silver film hardly progressed. As a result, in Comparative Examples 7 and 8, the volume resistivity of the silver film became as high as 400 μΩ·cm and 100 μΩ·cm, respectively. Contrary to these, in Examples 1 to 9 of the present invention, the film thickness of the silver film was as thick as 45 to 50 μm; and the volume resistivity of the silver film was as low as 7 to 11 μΩ·cm, because: the particle size distribution of the primary particles of the silver powder had the first peak within the range of the particle size of 20 nm to 70 nm and the second peak within the range of the particle size of 200 nm to 500 nm; the organic matters were decomposed in the extent of 50 mass % to 80 mass % (50 mass % or more) at 150° C.; and only gaseous carbon dioxide, the evaporated acetone and the evaporated water were generated without generation of other heat-generated gases in heating at 100° C.

Examples 10 to 12

As shown in Table 3, the silver films formed on the glass substrates of Examples 10 to 12 of the present invention were formed by varying the kinds of amine mixed with the silver powder as shown in Table 3 when the silver paste, which was the paste composition including the silver powder used in Example 1, was prepared. Except for the conditions shown in Table 3, the silver powder was prepared under the same conditions as in Example 1, and then the silver paste was prepared using this silver powder. The silver paste was applied on the glass substrate and dried and fired to form the silver film on the glass substrate.

Comparative Test 3 and Evaluation

With respect to the silver films formed on the glass substrates of Examples 10 to 12 of the present invention, the film thickness and the volume resistivity of the silver film were measured in the same manner as in Comparative Test 2. The results are shown in Table 3. In Table 3, the kinds of amine, the carbon number and mass average molecular weight contained in the paste composition containing silver powder are also shown.

TABLE 3

| | Amine in the paste composition including the silver powder | | | Silver film | |
|---|---|---|---|---|---|
| | Kind | Carbon number | Mass average molecular weight | Film thickness (μm) | Volume resistivity (μΩ · cm) |
| Example 10 | Hexylamine | 6 | 101.19 | 45 | 7 |
| Example 11 | Decylamine | 10 | 157.30 | 50 | 11 |
| Example 12 | Ethylhexylamine | 8 | 129.24 | 45 | 7 |

As is apparent from Table 3, in Examples 10 to 12 of the present invention, since the amine having the carbon number in the range of 6 to 10 and the mass average molecular weight in the range of 101.19 to 157.30 was used, the film thickness of the silver film was as thick as 45 to 50 μm and the volume resistivity of the silver film was as low as 7 to 11 μΩ·cm.

Examples 13 to 23

As shown in Table 4, the silver films formed on the glass substrates of Examples 13 to 23 of the present invention were formed by varying the kind of the silver salt in the silver salt aqueous solution; the kind of the carboxylic acid in the carboxylate aqueous solution; and the kind of the reducing agent in the reducing agent aqueous solution (condition), when the silver citrate slurry (silver carboxylate slurry) was prepared by simultaneously dripping the silver nitrate aqueous solution (silver salt aqueous solution) and the ammonium citrate aqueous solution (carboxylate aqueous solution) to the ion-exchanged water (water) as shown in Table 4. Except for the conditions shown in Table 4, the silver powders were prepared in the same manner as in Example 1. Then, the silver paste was prepared using this silver powder, this silver paste was applied on the glass substrate, dried and further fired to form the silver films on the glass substrates.

Comparative Test 4 and Evaluation

With respect to the silver powders of Examples 13 to 23 of the present invention, the particle size distribution of the primary particles of the silver powder; the decomposition rate (decomposition rate of the organic matters) of the organic matters covering the silver powder at a predetermined temperature; and kinds of the gases (kind of the heat-generated gas) derived from the organic matters coating the silver powder in heating the silver powder in the powder state, were measured in the same manner as in Comparative Test 1. In addition, with respect to the silver films formed on the glass substrates of Examples 13 to 23 of the present invention, the film thickness and the volume resistivity of the silver films were measured in the same manner as in Comparative Test 2. The results are shown in Table 4. In Table 4, the kinds of silver salt, the kind of the carboxylic acid, and the kind of the reducing agent contained in the silver carboxylate slurry are also shown. Among the kind of the heat-generated gases in Table 4, $CO_2$ is gaseous carbon dioxide; and acetone and water are evaporated substances thereof.

TABLE 4

| | Silver carboxylate slurry | | | Silver powder: Particle distribution of primary particles | | Silver powder: Decomposition rate of organic matters | Silver powder: Kind of heat-generated gas | Silver film | |
|---|---|---|---|---|---|---|---|---|---|
| | Silver salt | Carboxylic acid | Reducing agent | First peak (nm) | Second peak (nm) | (mass %) | | Film thickness (μm) | Volume resistivity (μΩ · m) |
| Example 13 | Silver nitrate | Glycolic acid | Hydrazine | 40 | 350 | 70 | $CO_2$, acetone, water | 45 | 9 |
| Example 14 | Silver nitrate | Glycolic acid | Formic acid | 30 | 400 | 65 | $CO_2$, acetone, water | 40 | 9 |
| Example 15 | Silver nitrate | Citric acid | Formic acid | 40 | 400 | 80 | $CO_2$, acetone, water | 45 | 7 |
| Example 16 | Silver nitrate | Ammonium malate | Formic acid | 50 | 450 | 70 | $CO_2$, acetone, water | 45 | 8 |
| Example 17 | Silver nitrate | Disodium maleate | Sodium oxalate | 30 | 300 | 50 | $CO_2$, acetone, water | 50 | 11 |
| Example 18 | Silver nitrate | Maionic acid | Sodium ascorbate | 20 | 300 | 50 | $CO_2$, acetone, water | 40 | 10 |
| Example 19 | Silver nitrate | Fumaric acid | Formic acid | 40 | 350 | 70 | $CO_2$, acetone, water | 45 | 9 |
| Example 20 | Silver nitrate | Succinic acid | Formic acid | 50 | 500 | 60 | $CO_2$, acetone, water | 45 | 10 |

TABLE 4-continued

| | Silver carboxylate slurry | | | Silver powder | | | | Silver film | |
|---|---|---|---|---|---|---|---|---|---|
| | | | | Particle distribution of primary particles | | Decomposition rate of | Kind of | | |
| | Silver salt | Carboxylic acid | Reducing agent | First peak (nm) | Second peak (nm) | organic matters (mass %) | heat-generated gas | Film thickness (μm) | Volume resistivity (μΩ · m) |
| Example 21 | Silver nitrate | Ammonium tartrate | Formic acid | 50 | 400 | 60 | $CO_2$, acetone, water | 45 | 10 |
| Example 22 | Silver chlorate | Glycolic acid | Hydrazine | 50 | 300 | 80 | $CO_2$, acetone, water | 45 | 8 |
| Example 23 | Silver nitrate silver phosphate | Glycolic acid | Hydrazine | 50 | 300 | 80 | $CO_2$, acetone, water | 45 | 8 |

As is apparent from Table 4, in Examples 13 to 23 of the present invention, in which the silver salt was one or more compounds selected from the group consisting of silver nitrate, silver chlorate and silver phosphate; and the carboxylic acid was a compound was a compound selected from glycolic acid, citric acid, ammonium malate (malic acid salt), disodium maleate (maleic acid salt), malonic acid, fumaric acid, succinic acid, and ammonium tartrate (tartaric acid salt); and the reducing agent is a compound selected from hydrazine, formic acid, sodium oxalate (oxalic acid salt), and sodium ascorbate (ascorbic acid salt), the thickness of the silver film was as thick as 40 to 50 μm; and the volume resistivity of the silver film was as low as 7 to 11 μΩ·cm.

REFERENCE SIGNS LIST

1: Silver salt aqueous solution (silver nitrate aqueous solution)
2: Carboxylate aqueous solution (ammonium citrate aqueous solution)
3: Water (ion-exchanged water)
4: Silver carboxylate slurry (silver citrate slurry)
5: Reducing agent aqueous solution (ammonium formate aqueous solution)

INDUSTRIAL APPLICABILITY

A silver powder and a paste composition more suitable for usage as a conductive material can be provided.

What is claimed is:

1. A method of producing a silver powder comprising the steps of:

dripping a silver salt aqueous solution kept at a temperature in a range of 30 to 90° C. and a carboxylate aqueous solution kept at a temperature in a range of 30 to 90° C. simultaneously over a period of 5 to 450 minutes in water at a temperature in a range of 30 to 90° C. while stirring the water, thereby preparing a silver carboxylate slurry;

dripping a reducing agent aqueous solution kept at a temperature in a range of 30 to 90° C. to the silver carboxylate slurry kept at a temperature in a range of 30 to 90° C., thereby obtaining a mixture of the silver carboxylate slurry and the reducing agent;

heating the mixture to a temperature in a range of 30 to 90° C. at a rate of temperature rise of 15° C./hour or less, holding a maximum temperature after the temperature rise for 1 to 5 hours and then retaining or lowering the temperature to 30° C. or less over a period of 30 minutes or less, thereby obtaining a silver powder slurry; and obtaining a silver powder by drying the silver powder slurry, wherein a particle size distribution of primary particles of the silver powder comprises a first peak of a particle size in a range of 20 nm to 70 nm and a second peak of a particle size in a range of 200 nm to 500 nm.

2. The method of producing a silver powder according to claim 1, wherein a silver salt in the silver salt aqueous solution is one or more compounds selected from a group consisting of: silver nitrate; silver chlorate; and silver phosphate.

3. The method of producing a silver powder according to claim 2, wherein a carboxylic acid in the carboxylate aqueous solution is one or more compound selected from a group consisting of: glycolic acid; citric acid; malic acid; maleic acid; malonic acid; fumaric acid; succinic acid; tartaric acid; and salts thereof.

4. The method of producing a silver powder according to claim 3, wherein a reducing agent in the reducing agent aqueous solution is one or more compound selected from a group consisting of: hydrazine; ascorbic acid; oxalic acid; formic acid; and salts thereof.

5. The method of producing a silver powder according to claim 2, wherein a reducing agent in the reducing agent aqueous solution is one or more compound selected from a group consisting of: hydrazine; ascorbic acid; oxalic acid; formic acid; and salts thereof.

6. The method of producing a silver powder according to claim 1, wherein a carboxylic acid in the carboxylate aqueous solution is one or more compound selected from a group consisting of: glycolic acid; citric acid; malic acid; maleic acid; malonic acid; fumaric acid; succinic acid; tartaric acid; and salts thereof.

7. The method of producing a silver powder according to claim 6, wherein a reducing agent in the reducing agent aqueous solution is one or more compound selected from a group consisting of: hydrazine; ascorbic acid; oxalic acid; formic acid; and salts thereof.

8. The method of producing a silver powder according to claim 1, wherein a reducing agent in the reducing agent aqueous solution is one or more compound selected from a group consisting of: hydrazine; ascorbic acid; oxalic acid; formic acid; and salts thereof.

9. The method of producing a silver powder according to claim 1, wherein lower limits of the temperatures of the silver salt aqueous solution, the carboxylate aqueous solution, and the water in the step of dripping are 50° C., lower limits of the temperatures of the reducing agent and the silver carboxylate slurry in the step of dripping a reducing agent are 50° C., and a lower limit of the temperature of heating in the step of heating is 70° C.

* * * * *